US006790091B2

(12) United States Patent
Palomäki et al.

(10) Patent No.: US 6,790,091 B2
(45) Date of Patent: Sep. 14, 2004

(54) SHIELDING ARRANGEMENT IN CONNECTOR AND CONNECTOR

(75) Inventors: Leo Palomäki, Vaasa (FI); Longinos Larikka, Sundom (FI)

(73) Assignee: Vacon Oyj, Vaasa (FI)

( * ) Notice: Subject to any disclaimer, the term of this patent is extended or adjusted under 35 U.S.C. 154(b) by 0 days.

(21) Appl. No.: 10/678,269

(22) Filed: Oct. 6, 2003

(65) Prior Publication Data

US 2004/0137791 A1 Jul. 15, 2004

(30) Foreign Application Priority Data

Oct. 14, 2002 (FI) ..... 20021816

(51) Int. Cl.[7] ..... H01P 13/66
(52) U.S. Cl. ..... 439/620
(58) Field of Search ..... 439/620

(56) References Cited

U.S. PATENT DOCUMENTS 4,413,871 A 11/1983 Swengel
4,992,061 A * 2/1991 Brush et al. ..... 439/620
5,221,216 A * 6/1993 Gabany et al. ..... 439/620
5,340,944 A * 8/1994 Wang ..... 174/52.1
5,475,347 A * 12/1995 Kwak ..... 333/185
5,577,937 A * 11/1996 Itoh et al. ..... 439/620
5,580,280 A * 12/1996 Minich et al. ..... 439/620
6,556,411 B1 * 4/2003 Hoeft et al. ..... 361/119
6,572,412 B2 * 6/2003 Beuther et al. ..... 439/620

FOREIGN PATENT DOCUMENTS

CH 692 687 A5 9/2002
DE 295 00 462 U 6/1995

* cited by examiner

*Primary Examiner*—Ross Gushi
(74) *Attorney, Agent, or Firm*—Oliff & Berridge PLC

(57) ABSTRACT

The invention relates to a shielding arrangement in a connector and to a connector enabling the use of the arrangement for connecting at least two electric conductors in a shielded manner. The connector comprises a body arranged to attach to a base. In addition, the connector has a receiving element for electrically connecting an entering electric conductor and an exiting electric conductor, said receiving element being arranged to attach to the body. A cavity open on one side is arranged to the body of the connector of the invention, the cavity being arranged to have a size suitable for receiving a shielding means in such a manner that, when the body is attached to its base, the body covers at least partly said shielding means.

8 Claims, 3 Drawing Sheets

SHIELDING ARRANGEMENT IN CONNECTOR AND CONNECTOR

BACKGROUND OF THE INVENTION

The invention relates to undesired interference at connection points in conductors, i.e. to disturbance and interference in low-voltage connectors.

When discussing undesired interference, the term electromagnetic compatibility (EMC) is usually used. All undesired interaction between a device, conductors or the surroundings thereof is considered interference. In connectors, the connection may be of conclusive importance with respect to the EMC properties of a device, so the significance of the connectors used in the connections of conductors should not be underestimated.

In low-voltage (LV) systems, in which the voltage does not exceed 1,000 V ac or 1,500 V dc, power supply lines and the control wires of actuators are typically places, where interference is conventionally eliminated from electric connectors by directing the interference from the connection to the ground of the body.

Shielding in connectors is conventionally implemented by installing a shielding means, such as a capacitor, between the connection and the ground of the body. Such an arrangement results in external connections, and the connections are exposed to contact and may break and cause a poor contact. Poor connections or incorrectly shielded connectors cause extra interference radiation.

Another problem in the above arrangement is the fastening of the capacitor or other shielding means, The shielding means requires space and is difficult to fasten. To facilitate installation, the conductors must be sufficiently long to make manual installation possible. A weakness in such an installation arrangement is a poor interference-class quality level caused by the long conductors of the shielding arrangement and an installation susceptible to interference. Due to the difficult fastening, the interference-class quality level often depends on the installer of the shielding arrangement and is, thus, difficult to predict.

BRIEF DESCRIPTION OF THE INVENTION

It is thus an object of the invention to develop a shielding arrangement and a connector implementing the arrangement in such a manner that the above-mentioned drawbacks can be avoided. The object of the invention is achieved by a shielding arrangement and connector that are characterized by what is stated in the independent claims. Preferred embodiments of the invention are described in the dependent claims.

The invention is based on the idea that a shielding arrangement and connector are arranged to a connector in such a manner that the shielding arrangement can be implemented in a secure manner inside the connector. The connector of the invention is arranged such that the shielding means can be placed inside the connector.

The conductors of the shielding arrangement of the invention can be made very short without affecting the installability. In many cases, it is possible to implement the shielding arrangement in the connector of the invention without separate conductors by utilizing the pins of the shielding means, such as the pins of the capacitor.

The shielding arrangement and connector of the invention provide a very short electric distance from the connector to the body serving as the grounding point, whereby interference is reduced. Too high impedance is then not generated by the conductors and connections of the shielding arrangement.

The size of the conductors entering the connector is often not known in advance, so the part of the connector receiving the conductor often needs to be oversized. The receiving part of the connector is often adjustable so as to fasten conductors with different conductor surface areas. The conductor surface area of the adjustable receiving part may vary between 25 and 95 $mm^2$ or 95 and 185 $mm^2$, for instance.

It is often possible to define the size of the outgoing conductor in advance. The outgoing conductor is almost invariably smaller than the largest possible conductor surface area of the receiving part. The outgoing conductor then does not require as much space from the connector. The space requirement of the outgoing conductor-side connection is thus smaller than that of the receiving part. The connector of the invention utilizes this space requirement difference by arranging on the side of the outgoing conductor a hollow space enabled by the space requirement difference. The shielding means can be placed in this hollow space in such a manner that the body part covers the shielding means placed in the space.

In the arrangement of the invention, the length of the shielding conductors is made as short as possible without affecting installability. The grounding of the shielding means installed between the connector and base can according to the invention be implemented by a connecting means and grounding strip, in many cases completely without separate conductors. The connection can then be made directly to the shielding component, such as to the pins of the capacitor, thus eliminating the two connection points that were earlier needed with the use of conductors and are vulnerable with respect to interference and reliability. The elimination of these two connection points is a particular advantage for shielding in a connector, and is obtained by arranging the shielding means inside the connector.

By using the grounding strip, the grounding point can be brought close enough to connect the pin of the shielding means directly to the grounding strip. Moving the grounding point close to the shielding means is done with the grounding strip that is arranged to shift interference as well as possible onward from the means to the base. The grounding strip is made of an electrically conducting material and its surface area is as large as possible. The size of the grounding strip is arranged such that, when the grounding strip is on the bottom surface of the connector body and the body is attached to the base, the grounding strip is covered under the body. The grounding strip is fastened to the base with the body by means of an electrically conducting fastening means, such as a screw.

BRIEF DESCRIPTION OF THE FIGURES

The invention will now be described in greater detail by means of preferred embodiments and with reference to the attached drawings, in which.

DETAILED DESCRIPTION OF THE INVENTION

Figure 1:
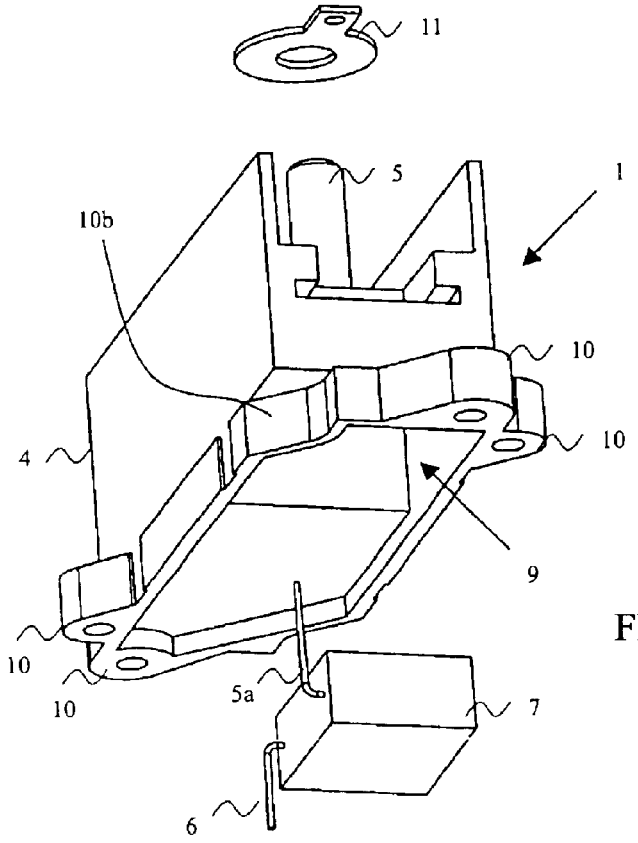
FIG. 1 shows the parts of a shielding arrangement of the invention and a connector according to the arrangement obliquely from below.

Reference is made to FIGS. 1 to 4 that describe a connector arrangement and connector. In FIG. 1, the connector 1 and the shielding arrangement connected to it are shown obliquely from below.

Figure 3:
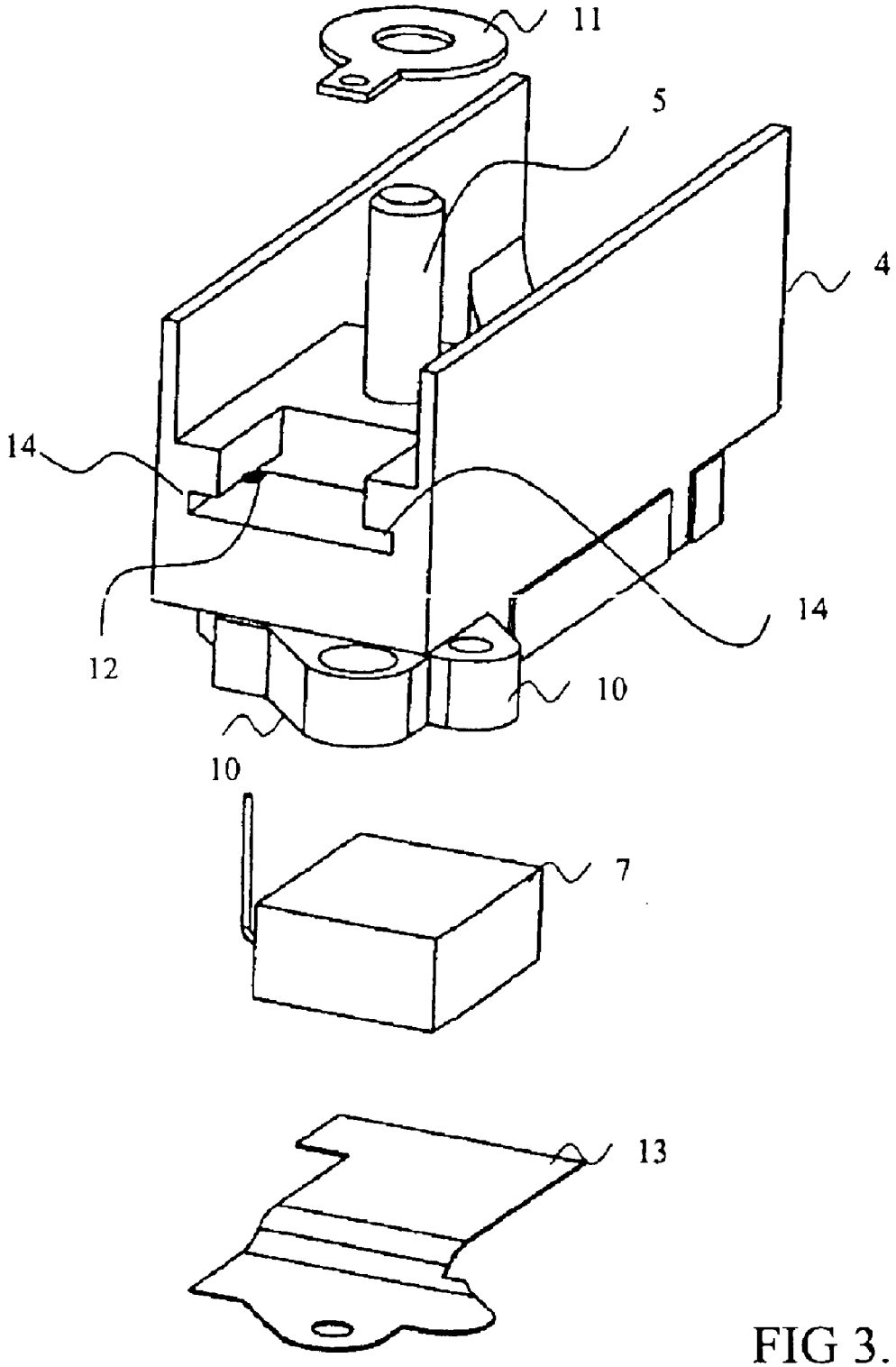
FIG. 3 shows the parts of a shielding arrangement of the invention and a connector according to the arrangement obliquely from above.
Figure 4:
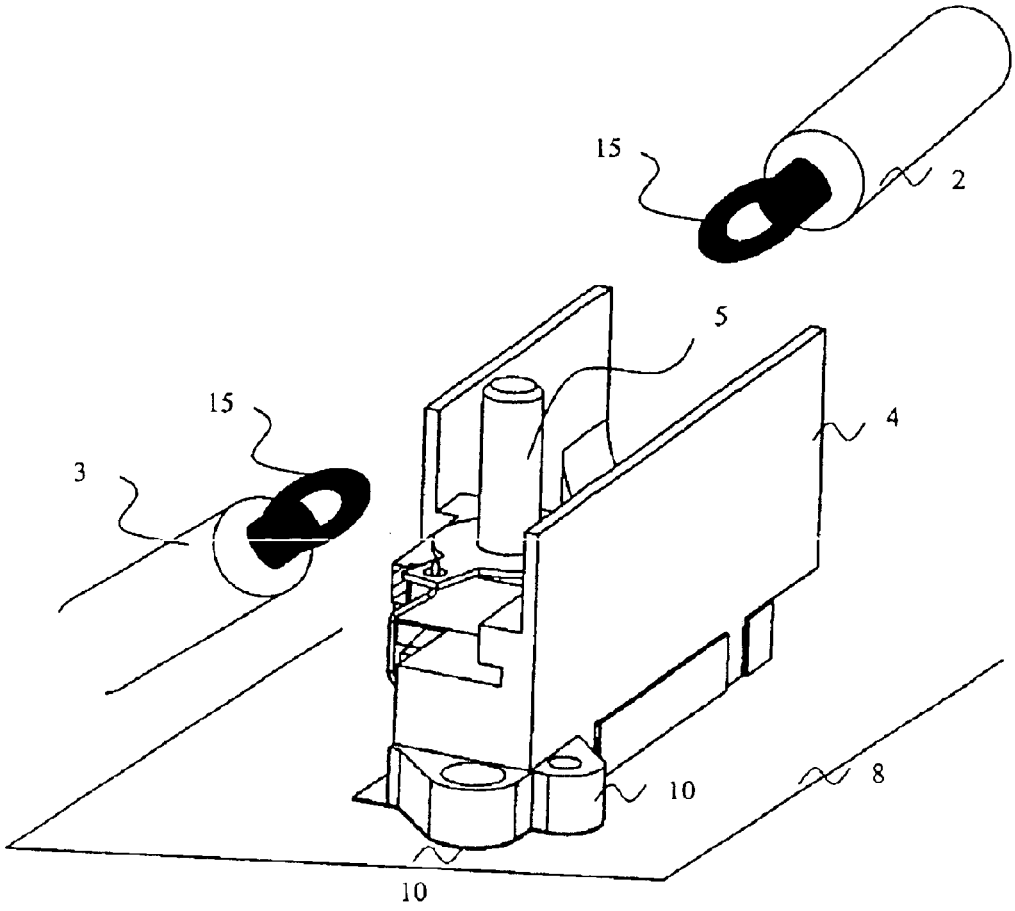
FIG. 4 is a partial cut-away view of a shielding arrangement of the invention and a connector according to the arrangement obliquely from above.

The connector 1 is intended for connecting the two electric conductors 2, 3 shown in FIG. 4. One of the conductors is the conductor 2 entering the connector and the other is the conductor 3 exiting the conductor. The conductors 2, 3 are fastened to a receiving element 5 fastenable to the body 4 of the connector 1. The receiving element 5 can be fastened to the body 4 in such a manner, for instance, that grooves 14 as shown in FIG. 3 are arranged to the body for placing the receiving element 5 therein. On the other hand, the receiving element 5 can be fixed to the body 4 during the molding of the body 4, for instance. The receiving element 5 is preferably a screwlike means, to which connecting means 15 at the ends of the conductors can be connected and tightened with a suitable fastening means (not shown), such as nut.

Figure 2:
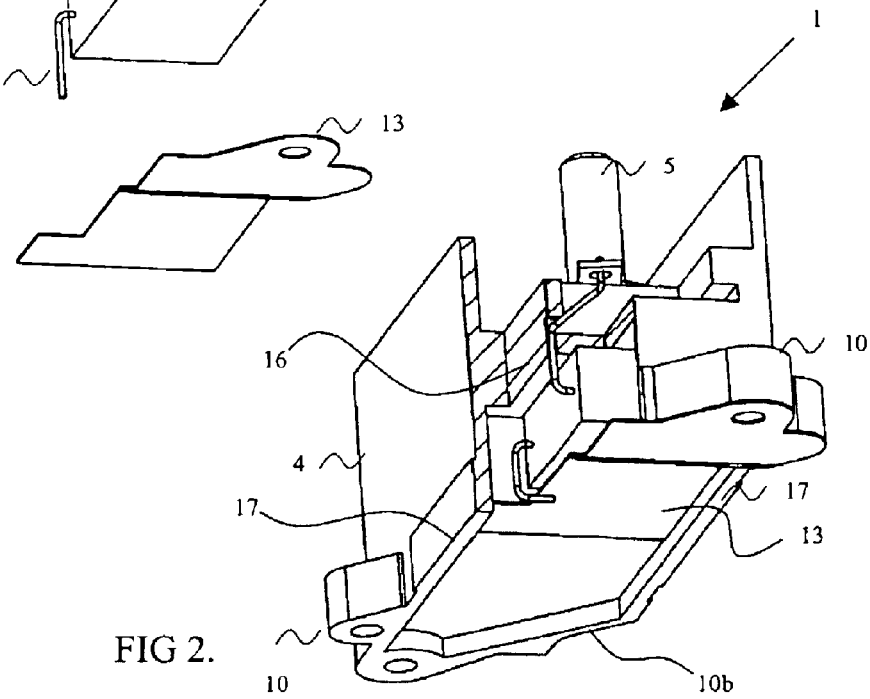
FIG. 2 is a partial cut-away view of a shielding arrangement of the invention and a connector according to the arrangement obliquely from below.

A cavity 9, or a corresponding space, which is open on one side, as shown in FIGS. 1 and 2, is arranged to the body 4 of the connector 1, the cavity 9 being arranged to have a size suitable for receiving a shielding means 7. The shielding means 7 is often a capacitor, when the intention is to eliminate interference propagating by conduction in the conductors. The shielding means 7 can also be some other shielding component, such as a surge arrester, resistor, varistor, or some other corresponding component.

The cavity 9 shown in FIGS. 1 and 2 is preferably open towards the body 4 when fastened at the edge settling against the base 8 in such a manner that when the body 4 is fastened to the base 8 shown in FIG. 4, said body 4 covers as much as possible and preferably entirely the shielding means 7. The surrounding body 4 then protects the shielding means 7 and the attached connections. In addition, the surrounding body 4 also protects the environment, if the shielding means 7 suddenly breaks, for instance when the shielding means 7 is a capacitor which may explode.

A wall 16 between the receiving element 5 of the body 4 and the electric part of the cavity 9 and the shielding means 7 also acts as an insulator. As shown in FIG. 3, the wall 16 has a bushing 12 that is done by arranging for the bushing 12 a hole made to the body 4 by drilling, for instance. To avoid short-circuiting, a first pin 5*a* of the shielding means should not be in the immediate vicinity of a second pin 6. Because the first pin 5*a* of the shielding means is threaded through the bushing 12 of the connector, the body 4 of the connector then also serves as the insulation distance separating the pins. In this case, the insulation distance refers to the distance between the conductors. If there are no conductors, the insulation distance refers to the distance of the first pin 5*a* of the shielding means 7 going through the bushing hole 12 from the second pin 6 and the grounding strip 13.

The base 8 according FIG. 4, to which the connector is fastened, is made of electrically conducting material. The base 8 is for instance sheet metal in the device and electrically at ground level. A grounding strip 13 is utilized in the connection to the base B. With a grounding strip having an as large surface area as possible, it is possible to bring the body, i.e. grounding point, closer to the shielding means 7. The second pin 6 of the shielding means is fastened to the grounding strip 13 by soldering, for instance.

The grounding strip 13 is preferably arranged with respect to the body 4 in such a manner that it can be fastened to the body without any connecting means. The grounding strip 13 is then a separate metal plate that need not be fastened by screwing, but it is oversized with respect to the body so that it can be arranged in place between protrusions 17 extending downwards from the body. The grounding strip 13 is arranged to be slightly wider than the protrusions 17 extending downwards from the bottom surface of the body. The grounding strip 13 can be placed on the bottom surface for instance by pressing the grounding strip to bend it and settle it under strain between the protrusions 17 arranged to the body 4. The grounding strip can then easily be detached without tools by bending the grounding strip 13 further and lifting it away from its space. Alternatively, grooves, into which the grounding strip can be arranged by sliding, can also be arranged to the inner surfaces of the bottom part of the body 4. The grounding strip 13 can also be fastened to the body 4 with appropriate means, such as screw-like means.

The grounding strip 13 can also be other than a strip, for instance a conductor-like means made of electrically conducting material. The grounding strip can also be molded into the connector and vary in outer dimensions. The aim of the grounding strip is good conductivity so that it does not act as an obstructing bottleneck for the transfer of interference, since the longer and thinner the grounding strip is, the poorer it transfers interference. In addition, the grounding strip is intended to enable the shortest possible electric distance to the body of the connector, since the closer the shielding arrangement is to the ground, the better is manages interference.

During the fastening of the connector 1, the grounding strip 13 is connected electrically to the base 8 by means of an electrically conducting connecting means (not shown), such as a screw. The grounding strip 13 is connected to the base 8 when the connector 1 is fastened. Elements 10, such as fastening lugs with a shaped hole, are arranged to the body 4 of the connector 1. An electrically conducting connecting means (not shown) can be placed through the hole in the element 10, with which the body 4 and the grounding strip 13 are fastened to the base 8. The connecting means can be a screw, bolt, rivet, peg, or the like. The connector 1 can be joined on its side surfaces with another connector having a similar body in such a manner that the side surfaces of the bodies 4 are arranged to settle together. The elements 10 arranged on the sides of the body 4 are located on at least two opposite comers of the body, and on the other opposite corners of the body 4, a recess 10*b* is arranged for settling at least a section of the element of the adjacent body therein.

A protective cover (not shown) should be arranged on top of the connector(s). The protective cover should be made such that, when attached to the connector, it protects the electric parts from contact. In addition, the protective cover should be detachable and re-attachable.

The reduction in the costs related to the shielding arrangement is made possible by implementing the shielding in connection with the assembly of the connector as a separate action in series production. This means that it is not necessary to use soldering during the assembly of the device, but soldering can be done earlier as series production in an industrial environment.

It is obvious to a person skilled in the art that while the technology advances, the basic idea of the invention can be implemented in many different ways. The invention and its embodiments are thus not restricted to the examples described above, but can vary within the scope of the claims.

What is claimed is:

1. A connector for joining at least two electric conductors in a shielded manner, the connector comprising:

a body arranged attachable to a base and having elements for attaching the body to said base, a receiving element for electrically connecting an entering electric conductor and an exiting electric conductor, said receiving element being arranged to attach to the body, comprising a cavity open on one side is arranged to the body, the size of the cavity being arranged to be such that a shielding means is insertable in it in such a manner that when the body is attached to its base, the body covers at least partly said shielding means, in the body, at least one bushing hole is arranged between the cavity and receiving element in such a manner that the receiving element and the shielding means in the cavity are connectable to each other through said bushing hole with a particularly short conductor.

2. A connector as claimed in claim 1, wherein on its side surfaces, the body is arranged to settle together with another similar body in such a manner that the elements arranged on the sides of the body are located on two opposite comers of the body, and on the other opposite comers, a recess is arranged for settling at least a section of the element of the adjacent body therein.

3. A connector as claimed in claim 1, wherein the open section of the cavity arranged in the body is on the side that is against the base of the body, when the body is attached.

4. A shielding arrangement in a connector for connecting at least two electric conductors, comprising:

a body attached to a base, a connection element for connecting the electric conductors, with a shielding means having two pins, a first pin and a second pin, connected to it, the first pin being connected to the connection element, the arrangement comprising:

a cavity arranged to the body of the connector, the cavity being open on the side that settles against the base, and that the shielding means is inserted in the cavity arranged in the connector, and the body covers said shielding means when attached to the base, and the second pin of the shielding means is galvanically coupled to the base.

5. A shielding arrangement in a connector as claimed in claim 4, wherein the second pin of the shielding means is connected to the base with a grounding strip located between the body and base.

6. A shielding arrangement in a connector as claimed in claim 4, wherein the first pin of the shielding means is connected to the connection element with a connecting means.

7. A shielding arrangement in a connector as claimed in claim 4, wherein the shielding means is a capacitor.

8. A shielding arrangement in a connector as claimed in claim 4, wherein the shielding means is a surge arrester.

* * * * *